US007461988B2

(12) United States Patent
Albisetti

(10) Patent No.: US 7,461,988 B2
(45) Date of Patent: Dec. 9, 2008

(54) PACKAGING AND APPLICATOR DEVICE FOR APPLYING A SUBSTANCE

(75) Inventor: Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 565 days.

(21) Appl. No.: 11/137,336

(22) Filed: May 26, 2005

(65) Prior Publication Data

US 2005/0265774 A1 Dec. 1, 2005

Related U.S. Application Data

(60) Provisional application No. 60/579,251, filed on Jun. 15, 2004.

(30) Foreign Application Priority Data

May 27, 2004 (FR) ..... 04 51051

(51) Int. Cl.
*A47L 13/22* (2006.01)
*A46B 11/04* (2006.01)

(52) U.S. Cl. ..... 401/116; 401/277; 401/280

(58) Field of Classification Search ..... 401/99, 401/100, 116, 117, 270, 277, 280, 281; 132/317
See application file for complete search history.

(56) References Cited

U.S. PATENT DOCUMENTS 2,611,915 A * 9/1952 Prokop et al. ..... 401/116
2,866,993 A 1/1959 Edelstone
2,945,252 A * 7/1960 Martinean, Jr. ..... 401/116
4,640,637 A 2/1987 Winthrop
4,768,529 A 9/1988 Mahruki
4,854,758 A 8/1989 Morel
4,902,152 A * 2/1990 Seidler ..... 401/117
5,397,195 A 3/1995 Goncalves

FOREIGN PATENT DOCUMENTS

EP 0 630 597 B1 12/1994
FR 1.070.029 7/1954
FR 1.555.567 12/1968
FR 2 236 446 2/1975

* cited by examiner

*Primary Examiner*—David J Walczak
(74) *Attorney, Agent, or Firm*—Oliff & Berridge PLC

(57) ABSTRACT

A packaging and applicator device for applying a substance may include: an applicator configured to apply the substance; a reservoir configured to contain the substance to be applied; a rotary ferrule configured to turn relative to the reservoir and including an opening; and a support carrying the applicator and co-operating with the ferrule and the reservoir so that while the ferrule is being turned relative to the reservoir, the support is axially displaced relative to the reservoir, the support being movable between an extended position in which the applicator extends, at least in part, out from the opening, and a retracted position, a space being formed between the support and the ferrule, thereby enabling substance to flow from the reservoir to the applicator, via said space, while the applicator is in the extended position.

49 Claims, 6 Drawing Sheets

PACKAGING AND APPLICATOR DEVICE FOR APPLYING A SUBSTANCE

This non-provisional application claims the benefit of French Application No. 04 51051 filed on May 27, 2004, and U.S. Provisional Application No. 60/579,251 filed on Jun. 15, 2004, the entire disclosures of which are incorporated herein by reference.

BACKGROUND

The present invention relates to a packaging and applicator device for applying a substance, the device comprising an applicator and a reservoir containing the substance to be applied, the applicator being movable relative to the reservoir between an extended position and a retracted position. Numerous devices of this type are known.

European patent EP 0 630 597 B1 describes a device in which the applicator is carried by a support that may be displaced relative to the reservoir by a ferrule that is capable of turning relative to the reservoir, and that co-operates with the support so that while the ferrule is being turned, said support is axially displaced relative to the reservoir. In that known device, the support is hollow, thereby enabling the substance contained in the reservoir to reach the applicator. A closure member that is stationary relative to the reservoir enables the support to be closed while the applicator is in its retracted position. Such a device presents a relatively complex structure.

French patent 1 555 567 discloses a device in which the applicator may be displaced relative to the reservoir by a slider. U.S. Pat. No. 2,866,993 describes a rather similar device in which the applicator is displaced relative to the reservoir by attraction between two magnets carried by the support of the applicator and the reservoir, respectively.

French patent 1 070 029 describes a device in which the applicator is carried by a support which co-operates with the reservoir by screw engagement. The reservoir includes an opening through which the applicator passes. At an end remote from said opening, the support is connected to a ferrule enabling the support to be turned relative to the reservoir. U.S. Pat. No. 4,768,529 describes a device that is rather similar to the device of French patent 1 070 029. With that device, a risk exists of excess substance flowing out after removing the closure cap that closes the reservoir orifice through which the applicator passes.

U.S. Pat. No. 4,640,637 describes a device in which the reservoir is formed by a cartridge that may be displaced, together with the applicator, in a structure for receiving the cartridge, and including a ferrule that may be turned so as to displace the cartridge.

U.S. Pat. No. 4,854,758 describes a device in which the support of the applicator is hollow, and co-operates with a rotary ferrule by screw engagement. The applicator is made of foam.

SUMMARY

A need exists for a device which, while being of relatively simple construction, enables application to be performed that is precise and comfortable, and enables an applicator to be used that is in the form of a paint brush, for example.

Exemplary embodiments of the invention may provide a packaging and applicator device for applying a substance, said device comprising: an applicator configured to apply the substance; a reservoir configured to contain the substance to be applied; a rotary ferrule configured to turn relative to the reservoir and including an opening; and a support carrying the applicator and co-operating with the ferrule and the reservoir so that while the ferrule is being turned relative to the reservoir, the support is axially displaced relative to the reservoir, the support being movable between an extended position in which the applicator extends, at least in part, out from the opening, and a retracted position, a space being formed between the support and the ferrule, thereby enabling substance to flow from the reservoir to the applicator, via said space, while the applicator is in the extended position.

In exemplary embodiments, a device of the invention has a relatively simple structure and may therefore be manufactured at a cost that is compatible with mass production.

Furthermore, in exemplary embodiments, the applicator may be stored while in the retracted position, without being hermetically separated from the substance, if so desired, thereby preventing the applicator from drying out. The applicator may even be impregnated with substance in the retracted position, so that the applicator is ready for use as soon as the applicator takes up the extended position.

Finally, in exemplary embodiments, the support of the applicator need not be hollow, thereby making it easier to fasten an applicator in the form of a tuft of bristles onto the support, for example.

In exemplary embodiments, the device may include a closure cap configured to close the reservoir. The closure cap may be arranged so as to be screwed onto the reservoir. Thus, the device may advantageously include anti-rotation means preventing the ferrule from turning so long as the closure cap has not moved through a predefined distance relative to the ferrule. This arrangement may prevent the applicator from being extended prematurely and may reduce the risk of damaging said applicator.

In exemplary embodiments, the anti-rotation means may comprise a first portion in relief on the ferrule, and a second portion in relief on the reservoir, the second portion in relief including a boss carried by a tab, the first portion in relief being configured to go past the boss by elastically deforming the tab radially outward, the closure cap being arranged, while closing the reservoir, to oppose deformation of the tab sufficiently to prevent the first portion in relief from going past the boss. In exemplary embodiments, the device may include a slot comprising firstly a portion extending circumferentially along the tab, and secondly a portion extending axially. The axially-extending portion may open at a free edge of the reservoir.

In exemplary embodiments, the tab may also include a second boss that projects radially outward, said second boss, for example, being adjacent to a helical thread with which the closure cap co-operates.

In exemplary embodiments, the reservoir may include a third portion in relief that is arranged to allow the first portion in relief to go past the third portion in relief by deforming elastically while the ferrule is bringing the applicator into the extended position. This may enable a click to be emitted, or may generate a hard point that may be felt by a user.

In exemplary embodiments, the reservoir may comprise a body, and a head that is fastened onto said body, the head being fastened onto the body by snap-fastening, for example. In exemplary embodiments, the head and the reservoir body may both include portions in relief, such as fluting, which co-operate mutually to prevent the head from turning relative to the reservoir body.

In exemplary embodiments, the reservoir may be configured to enable the user to vary an inside volume thereof. To this end, the body may, for example, be made of a flexible material. The body may be made by extrusion blow-molding and may comprise a multilayer structure.

In exemplary embodiments, the body may include at least one portion that is of flat cross-section, so as to make it easier for the user to deform.

In exemplary embodiments, the head may be made of a material that is more rigid than a material of the body.

In exemplary embodiments, the support may include a rod.

In such exemplary embodiments, the rod and the reservoir may be arranged such that the rod is displaceable relative to the reservoir without the rod turning perceptibly about an axis of the reservoir.

In exemplary embodiments, the reservoir may include at least one axially-extending guide finger configured to guide the rod. For example, the reservoir may include a plurality of axially-extending guide fingers configured to guide the rod. The fingers may be engaged between splines of the rod, for example.

In exemplary embodiments, the rod may be engaged in a central opening of a transverse wall of the reservoir. Said transverse wall may further include at least one peripheral opening, where appropriate or desired, so as to make it easier for the substance to flow between the reservoir and the applicator.

For example, the transverse wall may include a plurality of peripheral openings around the central opening in which the rod is engaged. The peripheral opening(s) may be formed between bridges of material via which the guide finger(s) is/are connected to a remainder of the reservoir.

In exemplary embodiments, the rod may include at least one longitudinal spline, and the central opening of the transverse wall may include at least one notch into which said spline is engaged. For example, the rod may include a plurality of longitudinal splines, and the central opening may include a plurality of corresponding notches.

In exemplary embodiments, at least one spline may have a dimension that, when measured perpendicularly to a longitudinal axis of the support, tapers toward an end of the rod that is situated toward an inside of the reservoir. At least one spline may also have a height that tapers toward an end of the rod that is situated beside the applicator.

In exemplary embodiments, the support and the ferrule may include first and second drive portions in relief that co-operate to cause the support to be displaced axially while said support and the ferrule are being turned relative to each other.

In exemplary embodiments, the ferrule may include at least one helical groove and the support may include at least one projecting portion in relief engaged in said helical groove. For example, the ferrule may include a plurality of helical grooves, and the support may include a plurality of projecting portions in relief engaged in said helical grooves. Each projecting portion in relief may comprise a helical-thread portion.

In exemplary embodiments, a perceptible clearance may be provided in the axial direction between the support and the ferrule. The clearance may be greater than or equal to 0.3 millimeters (mm), for example. Such clearance may make it easier for substance to flow between the support and the ferrule.

In exemplary embodiments, the projecting portion(s) in relief may be carried by a ring of the support. The ring may co-operate with the rod so as to form at least one channel that enables the substance to flow. For example, the device may include a plurality of channels between the rod and the ring. Advantageously, the rod and the ring may be made integrally as a single piece by molding plastics material. The ring may be connected to the rod by the splines, and the channels may be formed between the splines.

In exemplary embodiments, the support may include at least one portion in relief that is engaged both in a helical ramp that is stationary relative to the reservoir, and in a slideway that turns with the ferrule.

In exemplary embodiments, the closure cap may include an end wall that is arranged, while the reservoir is closed by the closure cap, so as to close the opening through which the applicator extends. The end wall may include a sealing lip that may bear against the outside or the inside of the ferrule, and, for example, against a chimney of said ferrule.

In exemplary embodiments, the applicator may comprise a tuft of bristles. The tuft of bristles may be fastened in a housing of the support, for example, by stapling.

In exemplary embodiments, a length of the applicator may be greater than or equal to 1 centimeter (cm), for example.

In exemplary embodiments, the reservoir may contain a substance configured to be applied to the nails, for example, a nail varnish or a care product for the nails. The substance may be configured to contain volatile organic solvents, where appropriate or desired.

Independently or in combination with the above, exemplary embodiments of the invention may provide a packaging and applicator device, comprising: an applicator configured to apply a substance, the applicator being movable between an extended position and a retracted position; a rotary ferrule configured to control displacement of the applicator between the extended and the retracted positions; and a closure cap configured to co-operate with the ferrule so as to close an opening thereof from which the applicator extends at least in part when in the extended position; the device including anti-rotation means preventing the ferrule from turning so long as the closure cap has not moved through a predefined stroke relative to the ferrule. In exemplary embodiments, the closure cap may include an annular sealing lip, as described above.

Such a disposition may make it possible to prevent the applicator from extending prematurely while the end wall of the closure cap is not far enough away from the opening, and therefore may make it possible to reduce the risk of damaging the applicator. In exemplary embodiments, the ferrule may be configured to turn over less than one complete revolution, for example, over about 350°. In exemplary embodiments, the axial displacement of the applicator may be greater than or equal to 10 mm, for example.

Independently or in combination with the above, exemplary embodiments of the invention may provide a packaging and applicator device for applying a substance, said device comprising: an applicator configured to apply the substance, the applicator being movable between an extended position and a retracted position; and a rotary ferrule configured to control displacement of the applicator between the retracted and the extended positions, the ferrule including a chimney that is narrow enough for the applicator in the retracted position to block the chimney sufficiently to prevent substance from flowing out while the ferrule is pointing downward.

In such embodiments, it may thus be possible for the user to open the device even with the head down, without any fear of a significant amount of substance leaking out.

BRIEF DESCRIPTION OF THE DRAWINGS

The invention will be better understood on reading the following detailed description of non-limiting embodiments thereof, and on examining the accompanying drawings, in which.

DETAILED DESCRIPTION OF EMBODIMENTS

The exemplary packaging and applicator device 1 shown in FIGS. 1 to 8 may include a reservoir 2 about an axis X, which may also correspond to the longitudinal axis of the device 1, as shown.

A substance P may comprise a nail varnish, for example.

The device 1 may also include a closure cap 4, which, in the exemplary embodiment shown, may be configured so as to be screwed onto the reservoir 2, and, for example, onto the head 6 of said reservoir.

Figure 1:
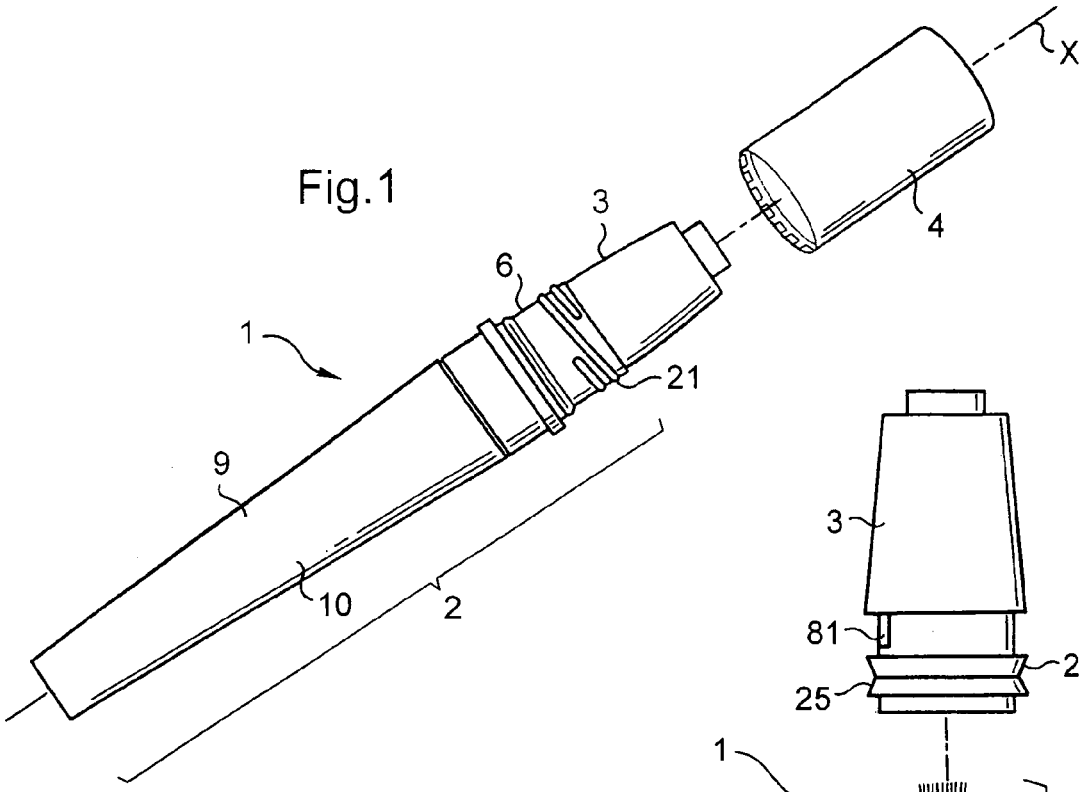
FIG. 1 is a diagrammatic, perspective view of an exemplary packaging and applicator device.
Figure 2:
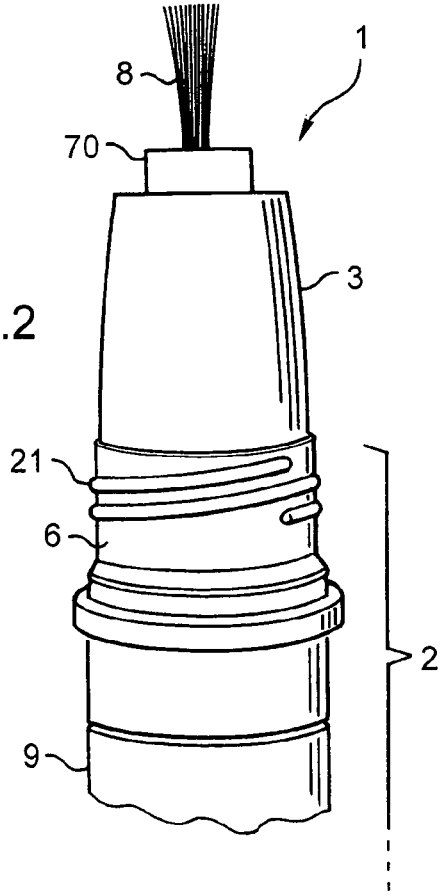
FIG. 2 is a fragmentary view of the device of FIG. 1 with the applicator extended.

The device 1 may include an applicator 8 that is movable along the axis X between an extended position shown in FIG. 2, and a retracted position shown in FIG. 1.

In the exemplary embodiment shown, the body 9 of the reservoir may have, over a main portion of a length thereof, an oblong cross-section that defines two substantially flat opposite faces 10 on which a user may press so as to reduce an inside volume of the reservoir 2, and so as to cause substance to flow onto the applicator 8.

Figure 3:
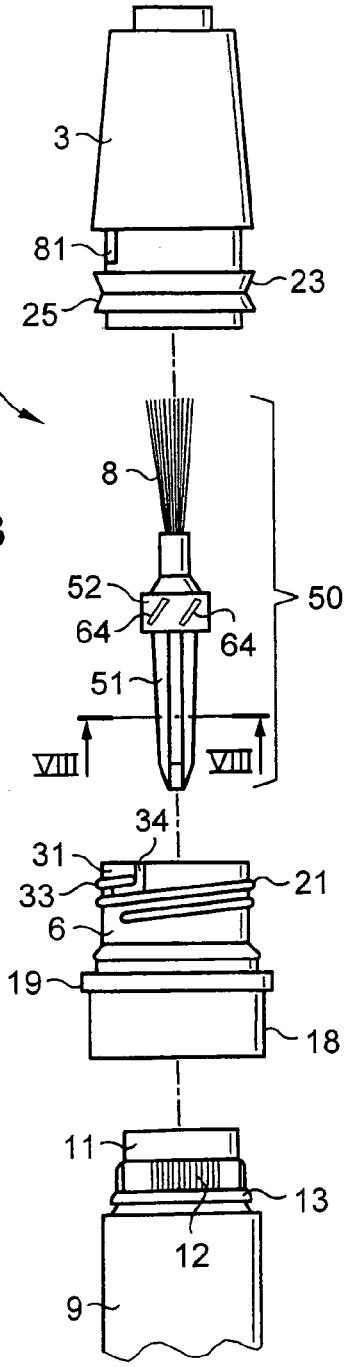
FIG. 3 is a diagrammatic and fragmentary, exploded view of the device of FIG. 1.

The body 9 of the reservoir and the head 6 may be advantageously constituted by parts that are made separately and then assembled together, as shown in FIG. 3. The head 6 may preferably be made out of a plastics material that is more rigid than a material of the body 9, for example, polypropylene. The body may be made of a single material, but the body may preferably be made by extrusion blow-molding to obtain a multilayer structure, for example, polyethylene and ethylene vinyl alcohol copolymer and polyethylene (PE/EVOH/PE), polyethylene and ethylene vinyl alcohol copolymer and polyamide (PE/EVOH/PA), or polyethylene and ethylene vinyl alcohol copolymer and polyethylene terephthalate (PE/EVOH/PET).

The body 9 may be made with a neck 11 provided, at a base thereof, with an annular flange 13 onto which the head 6 may be snap-fastened. In the exemplary embodiment shown, the neck 11 may also include fluting 12 that co-operates with complementary fluting 16 formed in the head 6 so as to prevent said head from turning relative to the body 9, as shown for example in the cross-sections of FIGS. 4 and 5.

The fluting 16 may be carried by an assembly skirt 18 of the head 6 that comes to cover an outside of the neck 11. An outside of the assembly skirt 18 may be provided with a collar 19 against which the closure cap 4 may bear axially once the closure cap 4 has been screwed home.

The head 6 may also include a neck 20 that extends the assembly skirt 18 upward, and that carries a thread 21 onto which the closure cap 4 may be screwed. The neck 20 may also serve to retain the ferrule 3 axially on the reservoir 2, while enabling the ferrule 3 to turn relative to said reservoir about the axis X. In the exemplary embodiment shown, an inside of the neck 20 may include portions in relief 22 that may be preferably evenly distributed angularly around the axis X, and on which the ferrule 3 may be snap-fastened by an annular flange 23, which may include a bottom face 24 that is substantially frustoconical, making insertion easier and making it easier to go past the portions in relief 22.

In the exemplary embodiment shown, below the flange 23, the ferrule 3 may further include a sealing lip 25 that comes to bear radially against the inner surface of the neck 20, the sealing lip 25 being oriented downward and radially outward in the exemplary embodiment shown.

Figure 6:
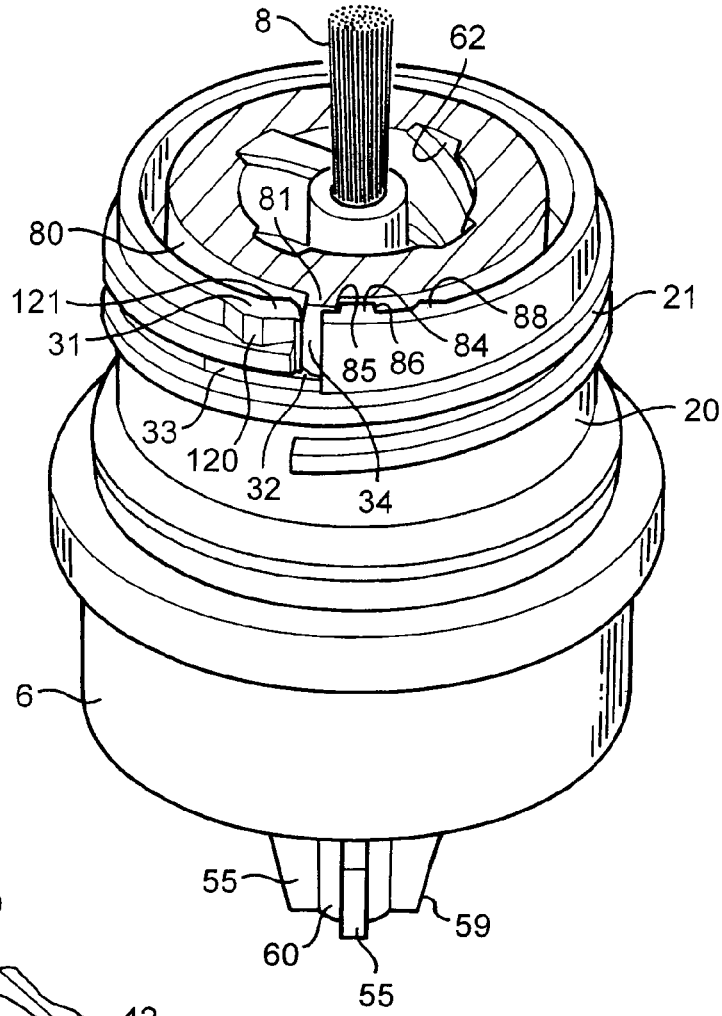
FIG. 6 is a larger scale view, partially in cross-section, showing the head of reservoir, the applicator, and the support.

As shown in FIG. 6, the neck 20 of the head 6 may include a tab 31 that is elastically deformable in the radial direction, for a purpose described below. The tab 31 may be formed on the neck 20 by a generally L-shaped slot 32, including a bottom portion 33 that extends circumferentially and a top portion 34 that extends axially as far as a top free edge of the head 6.

Figure 7:
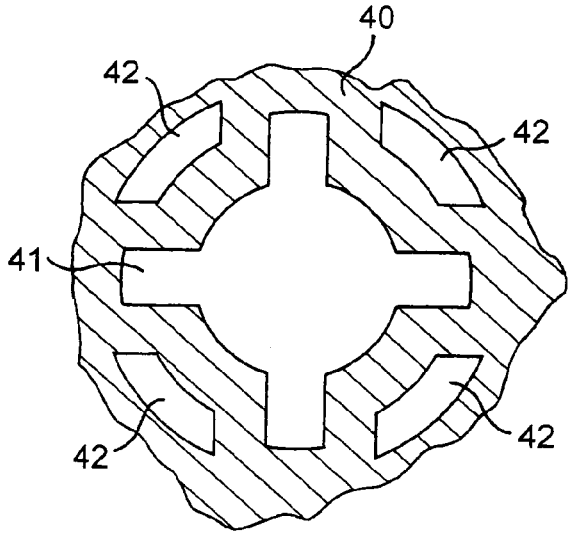
FIG. 7 is a fragmentary and diagrammatic cross-sectional view taken along VII-VII in FIG. 4.

Below the ferrule 3, the inside of the head 6 may include a transverse wall 40 through which a central opening 41 and peripheral openings 42 are formed, as shown in FIG. 7. The transverse wall 40 may be surmounted by a small O-ring 44 against which the bottom end-segment 45 of the ferrule 3 may bear.

An annular sealing lip 46 may bear against the radially inner surface of the neck 11 of the reservoir body 9, and may be fastened at a top thereof to the transverse wall 40, and radially outside the peripheral openings 42.

Figure 4:
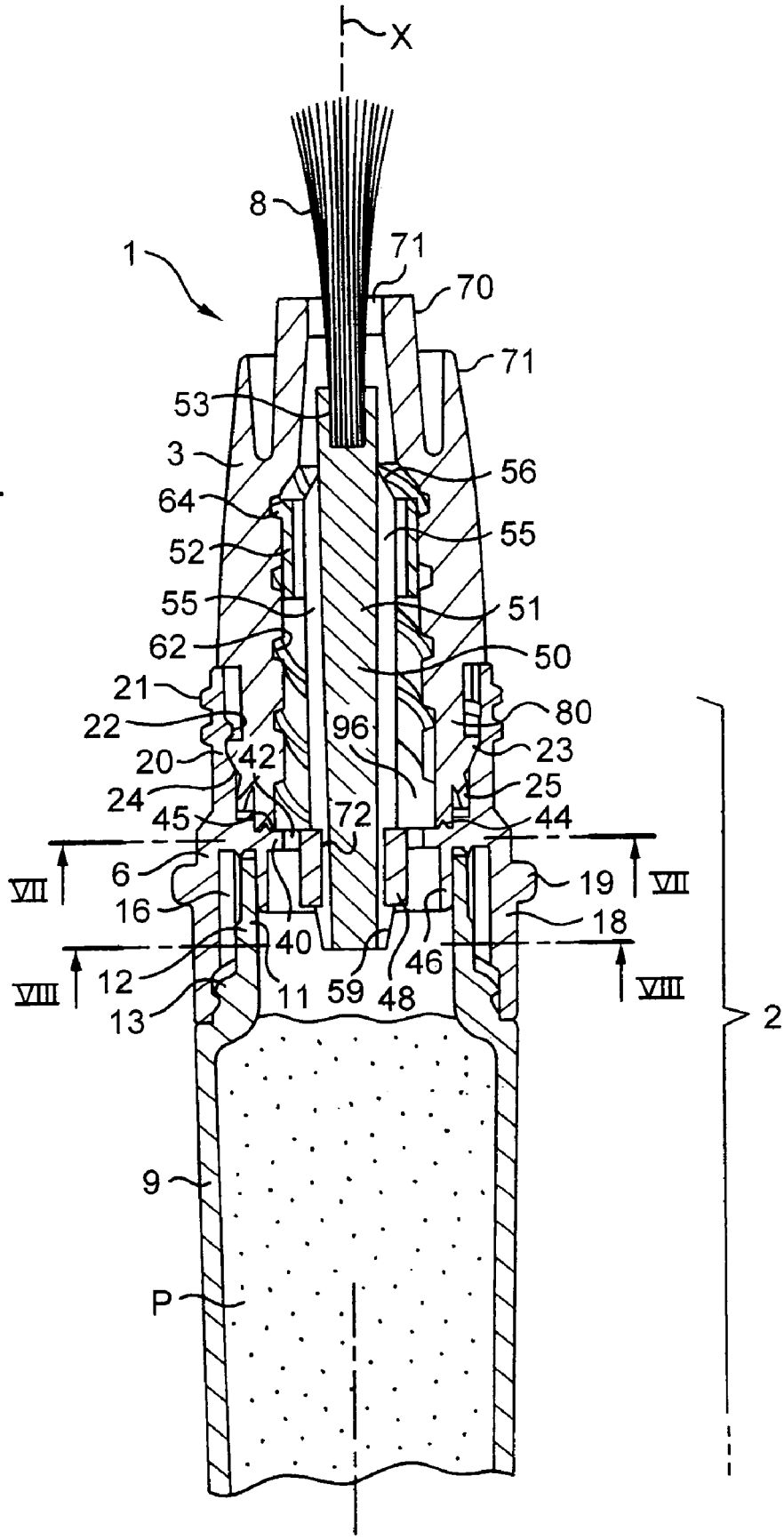
FIGS. 4 and 5 are diagrammatic, longitudinal cross-sectional views of the device of FIGS. 1 to 3, with the applicator being in the extended and the retracted positions, respectively.

Guide fingers 48, for a purpose described below, may be fastened at top ends thereof to the transverse wall 40, between the central opening 41 and the peripheral openings 42, as shown in FIG. 4.

The applicator 8 may be carried by a support 50 that may include a solid rod 51 of axis X and a ring 52 that extends around the rod 51.

In the exemplary embodiment shown, the applicator 8 may comprise a tuft of bristles stapled in a housing 53, formed at a top end of the rod 51, so as to form an applicator brush.

The ring 52 may be connected to the rod 51 by splines 55 that extend over an entire length of a portion of the rod 51 that is situated below the ring 52. The splines 55 may extend above the ring 52, where they may taper upward, as measured perpendicularly to the axis X, so as to have inclined edges 56. Channels 130 may be formed between the ring 52 and the rod 51, between two adjacent splines 55. Substance P may flow along the channels 130 to reach the applicator 8.

In the exemplary embodiment shown, there may be four splines 55, which may be evenly distributed angularly around the axis X. In a vicinity of bottom ends thereof, the splines 55 may taper slightly, as measured perpendicularly to the axis X, thereby also forming inclined edges 59, as shown in FIG. 4, making it easier to insert the rod 51 into the central opening 41.

Figure 8:
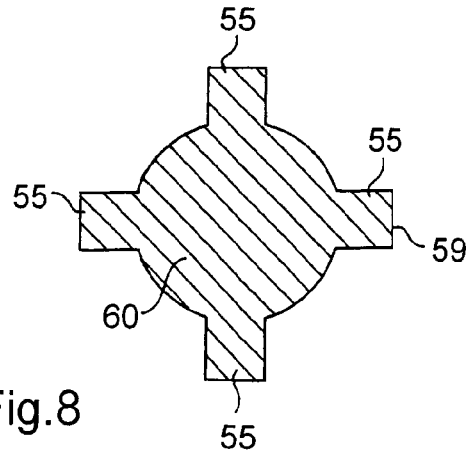
FIG. 8 is a cross-sectional view, taken along VIII-VIII in FIG. 3, showing the rod of the support.

As a result of the splines 55, the rod 51 may slide in the central opening 41 along the axis X without being able to turn relative to the reservoir 2 about the axis X, the central opening 41 including a cross-section that corresponds substantially to the cross-section of the portion of the rod 51 for sliding therein, as shown by a comparison of FIGS. 7 and 8.

The guide fingers 48 may be engaged between two adjacent splines 55 and may include radially inner faces that are adapted to substantially match a rounded shape of the core 60 of the rod 51.

In the exemplary embodiment shown, drive means may be provided so that turning the ferrule 3 relative to the reservoir 2 displaces the support 50 axially relative to the reservoir 2, thereby making it possible to bring the applicator 8 selectively into the extended position, or into the retracted position.

The drive means may be made in many ways without going beyond the ambit of the present invention.

In the exemplary embodiment of FIGS. 1 to 8, the drive means may comprise firstly, in an inner surface of the ferrule 3, at least one helical groove 62, and secondly, on the support 50, at least one corresponding portion in relief 64 that cooperates with said helical groove 62 so that while the ferrule 3 is being turned relative to the reservoir 2, said portion in relief 64 is displaced along the helical groove 62, and the support 50 moves along the axis X.

In the exemplary embodiment shown, the support 50 may include four helical thread portions 64 that project radially outward from the ring 52, and that are engaged in four corresponding helical grooves 62 formed on the radially inner surface of the ferrule 3.

Each thread portion 64 may preferably be engaged in the corresponding helical groove 62 with a perceptible axial clearance, for example, not less than 0.3 mm.

Figure 5:
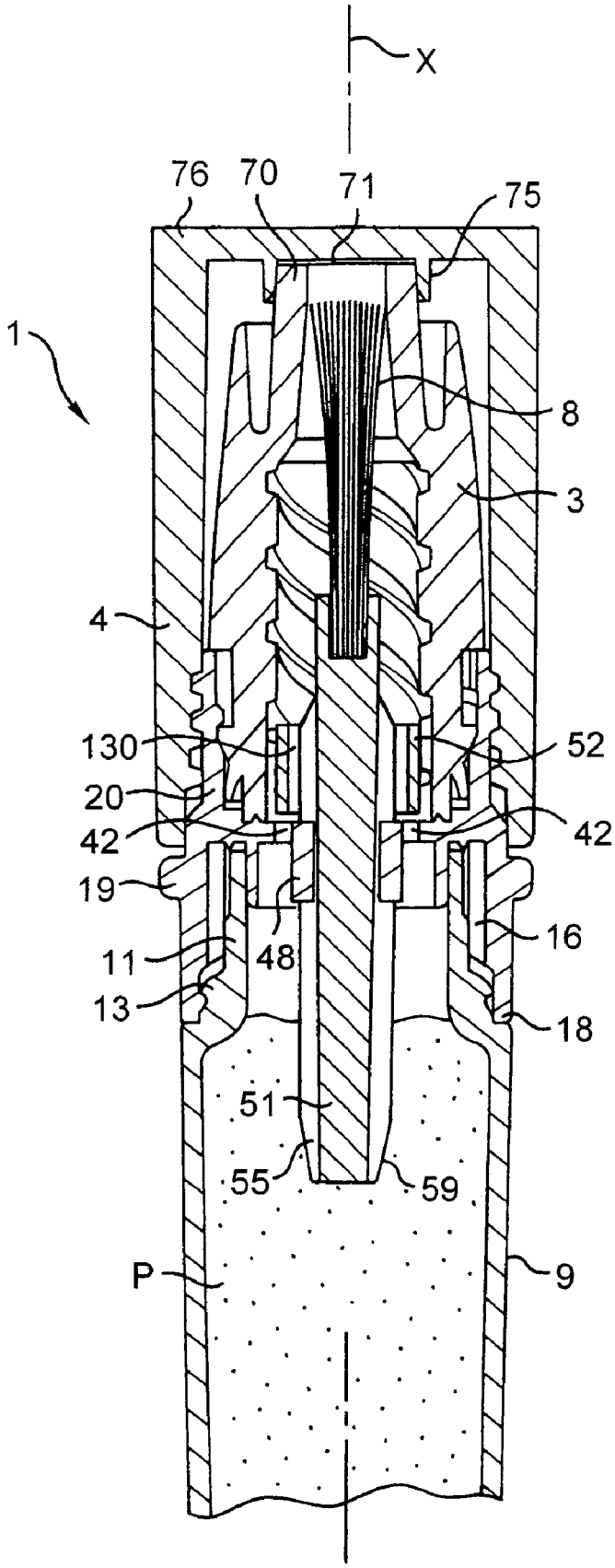

A top portion of the ferrule 3 may include a chimney 70 that is narrower than a portion of the ferrule carrying the helical grooves 62, and that defines an opening 71 through which the applicator 8 may extend while passing from the retracted position, shown in FIG. 5, to the extended position, shown in FIG. 4. A displacement stroke of the applicator 8 along axis X may lie in a range of about 10 mm to about 20 mm, for example.

In the exemplary embodiment shown, the ferrule 3 may also include an outer skirt 71 that extends over a fraction of a height of the chimney 70, and that terminates set-back from said chimney.

The closure cap 4 may include an annular sealing lip 75 that projects from an end wall 76 thereof, and that comes to bear in a leaktight manner on an outer periphery of the chimney 70 so as to close the opening 71, as shown in FIG. 5.

On a portion 80 engaged inside the neck 20, the ferrule 3 may include an abutment 81, shown in FIG. 6, and the neck 20 may include a corresponding abutment 84. The abutment 81 of the ferrule 3 may come to bear against a first side face 85 of the abutment 84 while the applicator is in the retracted position, and against an opposite second side face 86 while the applicator is in the extended position, once the ferrule has been turned through about 350°, for example. The neck 20 may include a boss 88 that is disposed such that the abutment 81 of the ferrule 3 may move past the boss 88 by deforming elastically before said ferrule 3 comes to bear against the face 86, so as to generate a click warning the user that the applicator has reached the extended position.

The tab 31 may include a radially inner boss 121 that the abutment 81 goes past when about to reach the face 85 of the abutment 84. This too may be accompanied by a click, so as to inform the user that the applicator is in the retracted position.

While the abutment 81 is going past the boss 121, the tab 31 may be radially deformed outward. In the exemplary embodiment shown, the tab may carry a radially outer boss 120 that is adjacent to the helical thread 21 onto which the closure cap 4 may be screwed.

The radially inner boss 121 may be situated on a path of the abutment 81 when the ring 3 turns, so that when the closure cap is in place on the head 6, radially outward deformation of the tab 31 is prevented to such an extent that the abutment 81 cannot go past the boss 121.

Thus, when the user starts to unscrew the closure cap 4, and when a certain amount of friction exists between the sealing lips 75 and the chimney 70, turning the closure cap 4 may not cause the ring 3 to turn, and premature extension of the applicator 8 may be prevented, which might otherwise damage the applicator 8.

The exemplary device 1 may function as follows.

It is assumed that the applicator 8 is in the retracted position, and that the closure cap 4 is in place, as shown in FIG. 5.

In FIG. 5, it should be observed that the applicator 8 may substantially blocks the chimney 70, thereby reducing the risk of any significant amount of fluid flowing out once the closure cap 4 has been removed, even if the opening 71 points downward. The inside diameter of the chimney 70 and the outside diameter of the portion of the rod 51 facing the opening 71 in the extended position of the applicator 8 may be determined as a function of the rheology of the substance, so as to obtain a desired flow of substance.

When the closure cap 4 starts to be unscrewed, the ferrule 3 may be prevented from turning, as explained below.

Once the closure cap 4 has been removed, the user may bring the applicator 8 into the extended position by turning the ferrule 3 relative to the reservoir 2. The user may feel when the ferrule 3 reaches the end of its rotation stroke by the abutment 81 going past the boss 88.

When the applicator 8 is extended, the applicator may already be soaked in substance, thereby enabling immediate application.

To feed substance P onto the applicator 8 during use, the user may squeeze the flexible body 9 of the reservoir with the thumb and the index finger by pressing on the flat faces 10, thereby causing additional substance P to be brought onto the applicator 8, the substance flowing via the peripheral openings 42 and via the clearance between the splines 55 and the transverse wall 40, then via the clearance between the portions in relief 64 of the ring 52 and the ferrule 3, and via the channels 130 between the ring and the rod, the substance also flowing through the space 96 around the rod 51 inside the ferrule 3. Once application has been completed, the user may turn the ferrule 3 in an opposite direction, thereby causing the applicator 8 to be retracted, and may put the closure cap 4 back in place.

Figure 9:
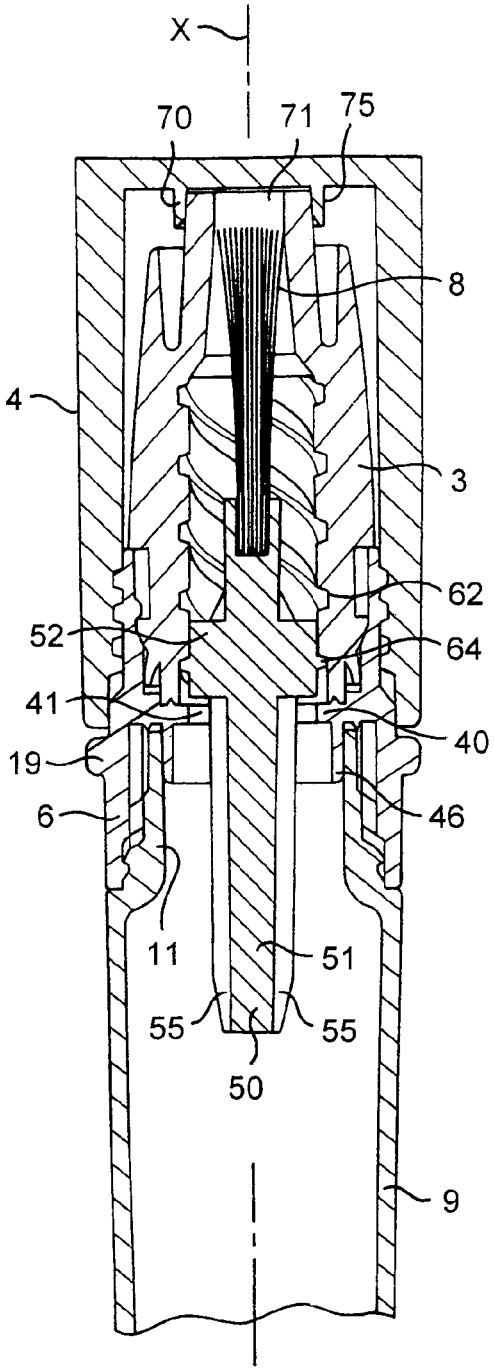
FIGS. 9, 10, and 11 are diagrammatic and fragmentary longitudinal cross-sectional views of various exemplary embodiments.

In another exemplary embodiment shown in FIG. 9, the transverse wall 40 may not carry the guide fingers 48, and may include only the central opening 41, thereby reducing the cross-section that is open to the flow of substance between the inside of the reservoir 9 and the inside of the ferrule 3. The head loss opposing the flow of substance coming from the reservoir and going to the applicator 8 during application may thus be increased. Such a disposition may be preferable, for example, when the substance is particularly fluid, or less viscous.

FIG. 9 illustrates a possibility of the support 50 not including channels between the ring 52 and the rod 51, so as to make it even more difficult for the substance to flow from the inside of the reservoir to the opening 71, the substance having to flow via the clearance between the portions in relief 64 and the corresponding helical grooves 62 to reach the applicator 8.

Figure 10:
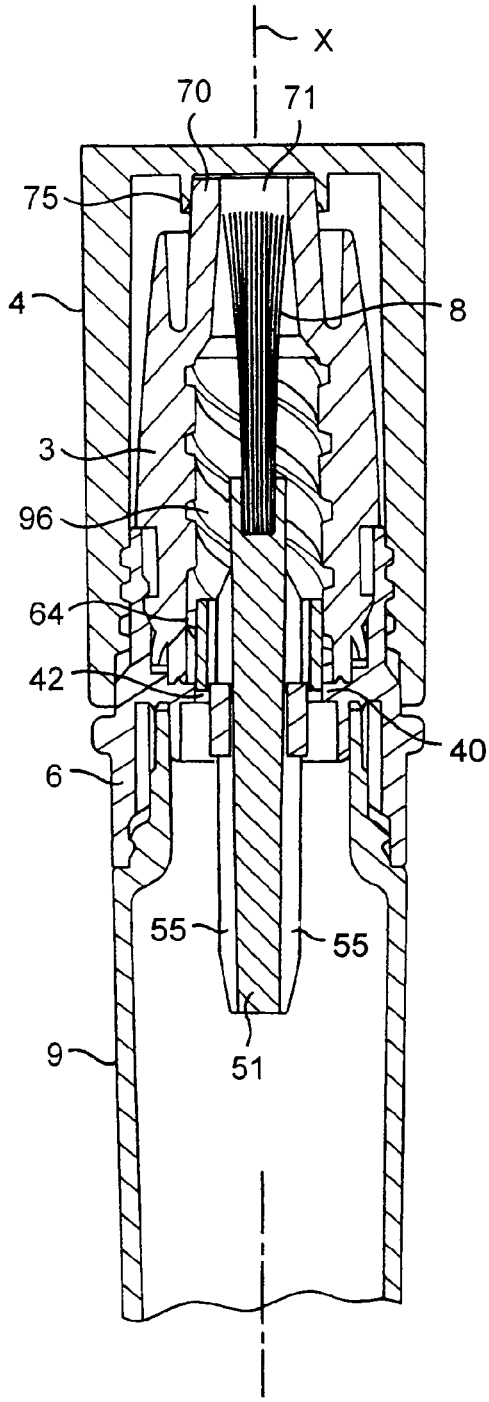

FIG. 10 shows a possibility of providing portions in relief on the ring 52 that are configured to close the peripheral openings 42 of the transverse wall 40, for example, while the applicator 8 is in the retracted position, so as to reduce the cross-section that is available to the flow of substance between the ferrule 3 and the inside of the reservoir 9 when the applicator is retracted, while benefiting from additional cross-section when the applicator is in the extended position, by releasing the peripheral openings 42.

Figure 11:
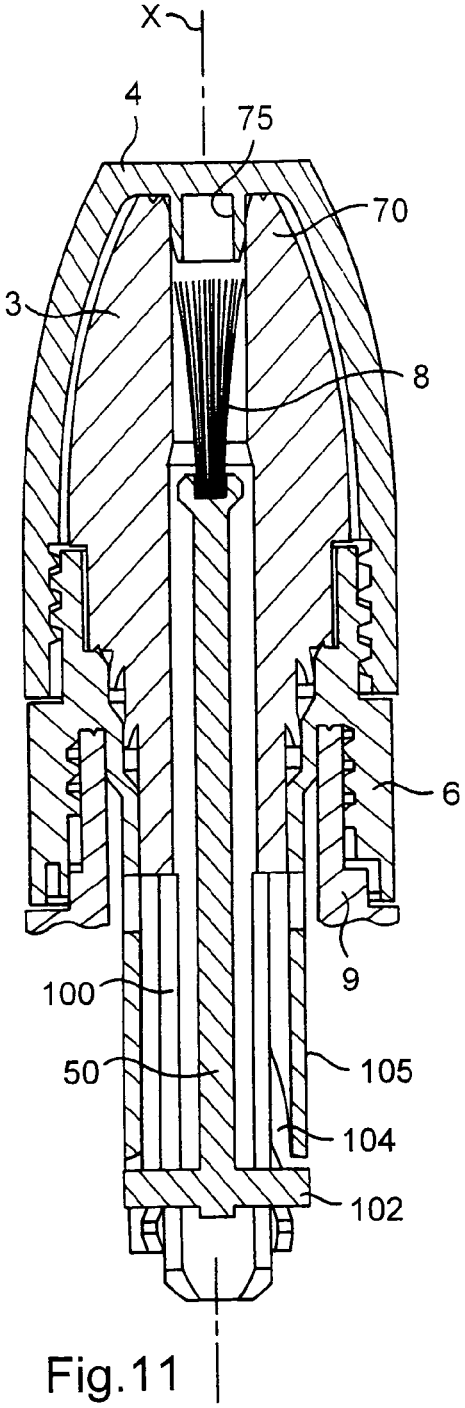
Figure 12:
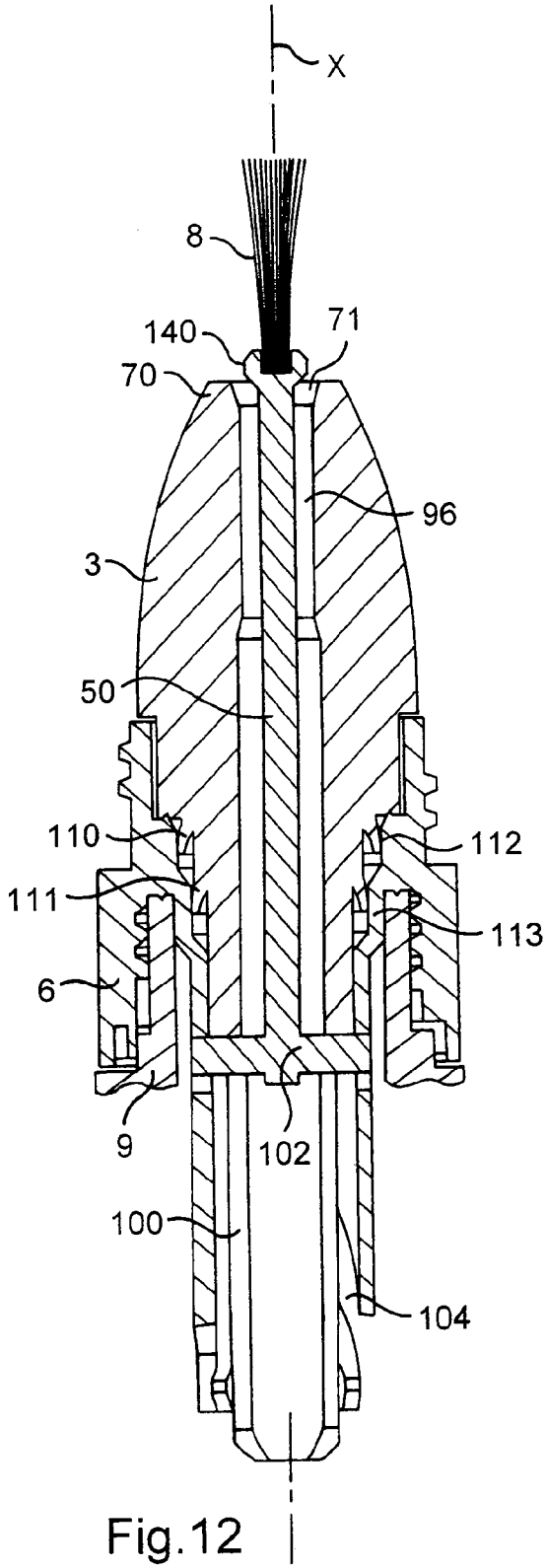
FIG. 12 is a view similar to FIG. 11, after the applicator support has been displaced.

FIGS. 11 and 12 show another exemplary embodiment in which the ferrule 3 does not include a thread, but a slideway 100 in which the support 50 may slide. The support 50 may include two diametrally opposite studs 102 that may be engaged in the slideway 100, in the exemplary embodiment shown. The studs 102 may be engaged, via ends thereof that project beyond the slideway 100, in a helical ramp 104 made in a skirt 105 that is secured to the head 6, for example, that is made integrally as a single piece with said head 6.

Thus, when the ferrule 3 is turned relative to the head 6, the studs 102 may be moved along the helical ramp 104 and may cause the support 50 to be displaced axially relative to the ferrule 3, so the applicator 8 may thus pass from a retracted position, shown in FIG. 11, to an extended position, shown in FIG. 12.

FIGS. 11 and 12 also show a possibility of the closure cap 4 including an annular sealing lip 75 that comes to be engaged inside the chimney 70.

FIG. 12 illustrates that the support 50 may co-operate with the opening 71 of the chimney 70 to form an annular passage with a width that may be selected as a function of the viscosity characteristics of the substance P, for example. For example, the support 50 may include a wide head 140 around the housing that receives the applicator 8.

In the exemplary embodiment shown, the ferrule 3 may be made with two annular sealing lips 110 and 111, sloping downward and radially outward, and respectively bearing against two corresponding cylindrical surfaces 112 and 113 of the head 6.

As in the exemplary embodiments described above, while the applicator 8 is in the extended position, the substance P may flow from the inside of the reservoir 9 to the applicator 8 by passing via the annular space 96 between the support 50 and the inside of the ferrule 3.

Naturally, the invention is not limited to the exemplary embodiments described above.

For example, it is possible to combine characteristics of the various exemplary embodiments with one another.

Throughout the description, including in the claims, the term "comprising a" or "including a" should be understood as being synonymous with "comprising at least one" or "including at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator device for applying a substance, said device comprising:

an applicator configured to apply the substance;

a reservoir configured to contain the substance to be applied;

a rotary ferrule configured to turn relative to the reservoir and including an opening; and a support carrying the applicator and co-operating with the ferrule and the reservoir so that while the ferrule is being turned relative to the reservoir, the support is axially displaced relative to the reservoir, the support being movable between an extended position in which the applicator extends, at least in part, out from the opening, and a retracted position, a space being formed between the support and the ferrule, thereby enabling substance to flow from the reservoir to the applicator, via said space, while the applicator is in the extended position.

2. A device according to claim 1, further comprising a closure cap configured to close the reservoir.

3. A device according to claim 2, wherein the closure cap includes an end wall that is arranged, while the reservoir is closed by the closure cap, so as to close the opening of the ferrule.

4. A device according to claim 3, wherein the cap includes a sealing lip that bears against the ferrule when the cap closes the opening of the ferrule.

5. A device according to claim 2, wherein the cap is arranged so as to be screwed onto the reservoir.

6. A device according to claim 2, further comprising anti-rotation means preventing the ferrule from turning so long as the closure cap has not moved through a predefined stroke relative to the ferrule.

7. A device according to claim 6, wherein the anti-rotation means comprise a first portion in relief on the ferrule, and a second portion in relief including a boss carried by a tab on the reservoir, the first portion in relief being configured to go past the boss by elastically deforming the tab radially outward, the closure cap being arranged, while closing the reservoir, to oppose deformation of the tab sufficiently to prevent the first portion in relief from going past the boss.

8. A device according to claim 7, further comprising a slot comprising a portion extending circumferentially along the tab, and a portion extending axially.

9. A device according to claim 8, wherein the axially-extending portion opens at a free edge of the reservoir.

10. A device according to claim 7, wherein the tab also includes a second boss that projects radially outward, said second boss being adjacent to a helical thread with which the closure cap co-operates.

11. A device according to claim 7, wherein the reservoir includes a third portion in relief that is arranged to allow the first portion in relief to go past the third portion in relief by deforming elastically while the ferrule is bringing the applicator into the extended position.

12. A device according to claim 1, wherein the reservoir comprises a body, and a head that is fastened onto said body.

13. A device according to claim 12, wherein the head is fastened onto the body by snap-fastening.

14. A device according to claim 12, wherein the head and the reservoir body both include fluting, which co-operate mutually to prevent the head from turning relative to the reservoir body.

15. A device according to claim 12, wherein the body is made of a flexible material.

16. A device according to claim 12, wherein the body includes at least one portion of flat cross-section.

17. A device according to claim 12, wherein the head is made of a material that is more rigid than a material of the body.

18. A device according to claim 12, wherein the body is made by extrusion blow-molding.

19. A device according to claim 18, wherein the body comprises a multilayer structure.

20. A device according to claim 1, wherein the reservoir is configured to enable a user to vary an inside volume thereof.

21. A device according to claim 1, wherein the support includes a rod.

22. A device according to claim 21, wherein the rod and the reservoir are arranged such that the rod is displaceable relative to the reservoir without the rod turning perceptibly about an axis of the reservoir.

23. A device according to claim 21, wherein the reservoir includes at least one axially-extending guide finger arranged to guide the rod.

24. A device according to claim 23, wherein the reservoir includes a plurality of axially-extending guide fingers for guiding the rod.

25. A device according to claim 21, wherein the rod is engaged in a central opening of a transverse wall of the reservoir.

26. A device according to claim 25, wherein the transverse wall further includes at least one peripheral opening.

27. A device according to claim 26, wherein the transverse wall includes a plurality of peripheral openings.

28. A device according to claim 26, wherein the reservoir includes at least one axially-extending guide finger arranged to guide the rod, and the at least one peripheral opening is formed between bridges of material via which at least one guide finger is connected to a remainder of the reservoir.

29. A device according to claim 25, wherein there is only one central opening.

30. A device according to claim 21, wherein the rod includes at least one longitudinal spline, and wherein the reservoir includes a transverse wall having a central opening including at least one notch into which the spline is engaged.

31. A device according to claim 30, wherein the rod includes a plurality of longitudinal splines, and the central opening includes a plurality of corresponding notches.

32. A device according to claim 31, wherein at least one of the plurality of splines has a height that tapers toward an end of the rod that is situated beside the applicator.

33. A device according to claim 30, wherein at least one spline has a dimension that, when measured perpendicularly to a longitudinal axis of the support, tapers toward an end of the rod that is situated toward an inside of the reservoir.

34. A device according to claim 1, wherein the support and the ferrule include first and second drive portions in relief that co-operate in such a manner as to cause the support to be displaced axially while said support and the ferrule are being turned relative to each other.

35. A device according to claim 34, wherein perceptible clearance is provided in an axial direction between the support and the ferrule.

36. A device according to claim 35, wherein the perceptible clearance is not less than 0.3 mm.

37. A device according to claim 35, wherein the ferrule includes at least one helical groove, and the support includes at least one projecting portion in relief engaged in said helical groove.

38. A device according to claim 37, wherein the ferrule includes a plurality of helical grooves, and the support includes a plurality of projecting portions in relief engaged in said helical grooves.

39. A device according to claim 37, wherein the at least one projecting portion in relief comprises a helical-thread portion.

40. A device according to claim 37, wherein the at least one projecting portion in relief is carried by a ring of the support.

41. A device according to claim 40, wherein the rod and the ring are made integrally as a single piece.

42. A device according to claim 40, wherein the ring co-operates with the rod so as to form at least one channel enabling the substance to flow.

43. A device according to claim 42, further comprising a plurality of channels between the rod and the ring.

44. A device according to claim 35, wherein the space between the support and the ferrule constitutes the only passage available to substance flowing from the reservoir to the opening of the ferrule.

45. A device according to claim 34, wherein the support includes at least one portion in relief that is engaged both in a helical ramp that is stationary relative to the reservoir, and in a slideway that turns with the ferrule.

46. A device according to claim 1, wherein the applicator comprises a tuft of bristles.

47. A device according to claim 46, wherein the tuft of bristles is fastened in a housing of the support by stapling.

48. A device according to claim 1, wherein a length of the applicator is not less than 1 cm.

49. A device according to claim 1, wherein the reservoir contains a substance configured to be applied to the nails.

* * * * *